US008936062B2

(12) United States Patent
Huang

(10) Patent No.: US 8,936,062 B2
(45) Date of Patent: Jan. 20, 2015

(54) CURTAIN STRUCTURE WITHOUT DRAWSTRING

(71) Applicant: Hua-Chi Huang, Changhua (TW)

(72) Inventor: Hua-Chi Huang, Changhua (TW)

( * ) Notice: Subject to any disclaimer, the term of this patent is extended or adjusted under 35 U.S.C. 154(b) by 162 days.

(21) Appl. No.: 13/846,766

(22) Filed: Mar. 18, 2013

(65) Prior Publication Data

US 2014/0262063 A1 Sep. 18, 2014

(51) Int. Cl.
*E06B 9/322* (2006.01)

(52) U.S. Cl.
CPC ..... *E06B 9/322* (2013.01)
USPC ..... 160/170; 160/297

(58) Field of Classification Search
USPC ..... 160/170, 297, 84.01, 84.02, 191, 192, 160/168.1 R, 173 R, 188
See application file for complete search history.

(56) References Cited

U.S. PATENT DOCUMENTS

| | | | | |
|---|---|---|---|---|
| 2,614,629 | A * | 10/1952 | Bleibtreu | 160/297 |
| 4,009,745 | A * | 3/1977 | Erpenbeck | 160/297 |
| 6,401,792 | B1 * | 6/2002 | Mullet et al. | 160/188 |
| 6,529,323 | B2 * | 3/2003 | Okumura | 359/461 |
| 6,571,853 | B1 * | 6/2003 | Ciuca et al. | 160/170 |
| 7,281,563 | B2 * | 10/2007 | Wu | 160/170 |
| 7,406,995 | B2 * | 8/2008 | Huang | 160/170 |
| 7,984,745 | B2 * | 7/2011 | Wen et al. | 160/170 |
| 8,245,756 | B2 * | 8/2012 | Cheng et al. | 160/170 |
| 8,281,846 | B2 * | 10/2012 | Zhu | 160/319 |
| 8,517,081 | B2 * | 8/2013 | Huang | 160/297 |
| 8,720,523 | B2 * | 5/2014 | Nakamura | 160/84.03 |
| 8,763,674 | B2 * | 7/2014 | Kataoka et al. | 160/120 |
| 2010/0206492 | A1 * | 8/2010 | Shevick | 160/170 |
| 2012/0298318 | A1 * | 11/2012 | Wolek | 160/299 |
| 2013/0112353 | A1 * | 5/2013 | Sengelaub | 160/84.02 |
| 2013/0220561 | A1 * | 8/2013 | Yu et al. | 160/340 |
| 2014/0083631 | A1 * | 3/2014 | Huang | 160/170 |
| 2014/0290871 | A1 * | 10/2014 | Muto | 160/84.01 |

* cited by examiner

*Primary Examiner* — Katherine Mitchell
*Assistant Examiner* — Johnnie A Shablack
(74) *Attorney, Agent, or Firm* — Che-Yang Chen; Law Office of Michael Chen

(57) ABSTRACT

A curtain structure without drawstring may include a curtain unit, a string scrolling base and an upper cover. The string scrolling base has a shell disposed in the base of the curtain unit, center portion of the shell having a shaft, both sides of which having a positioning shaft, and a line slot formed on both side walls of the positioning shaft, wherein upper periphery of rotating base has driving teeth having at least one groove, restricting guiding groove and arc rail groove on top surface thereof, and a driving unit is disposed on the positioning shafts, the driving unit having a rod to secure the string collecting bodies, and conjugating teeth are linked with the driving teeth of the rotating base; and an upper cover having a restricting groove corresponding to the rotating base, and a ball restricted in the groove of the restricting groove and the rotating base.

4 Claims, 13 Drawing Sheets

CURTAIN STRUCTURE WITHOUT DRAWSTRING

FIELD OF THE INVENTION

The present invention relates to a curtain structure, and more particularly to a curtain structure without drawstring.

BACKGROUND OF THE INVENTION

FIG. 13 shows a conventional curtain structure without drawstrings, including a curtain unit (40) having an upper beam (41) with a receiving space (411), and a string controller (42) is inside the receiving space (411). A spring is in the string controller (42) and can be extended to have a string collecting body (421). A guiding unit (43) is disposed on both sides of the receiving space (411) corresponding to the string collecting body (421), and the guiding unit (43) has two restricting rail stick (431). The string collecting body (421) passes through the guiding unit (43) to connect curtain pieces (44), and is finally secured at a weighted piece (45), whose weight is corresponding to the spring, so that the weighted piece (45) and spring can be balanced and the curtain pieces (44) can expand and restore by pulling or pushing the weighted piece (45). However, the structure of the string controller (42) is complicated and the weighted piece (45) has to be used corresponding to the spring, so it may be difficult to control the curtain unit (40). Also, when the string collecting body (421) passes through the guiding unit (43), it has to circle between the two restricting rail stick (431), which makes the entire assembly process difficult and may increase the costs during assembly process. Therefore, there remains a need for a new and improved curtain structure to overcome the problems stated above.

SUMMARY OF THE INVENTION

The technical problem the present invention wants to solve is that the structure of the string controller in conventional no-string curtain is complicated and the weighted piece has to be used corresponding to the spring, so it may be difficult to control the curtain unit. Also, when the string collecting body passes through the guiding unit, it has to circle between the two restricting rail stick, which makes the entire assembly process difficult and may increase the costs during assembly process.

A curtain structure without drawstring may include a curtain unit, a string scrolling base and an upper cover. The curtain unit has a base and curtain pieces disposed downward therefrom. The base is connected and driven by two string collecting bodies and the bottom of the base has a board. The string scrolling base has a shell disposed in the base of the curtain unit, and two positioning slot are disposed in the base of the curtain unit, and bottom of the shell of the string scrolling base has protruding ribs, so as to secure the string scrolling base inside the base. Center of the shell has a shaft, both sides of which have a positioning shaft, and a line slot is formed on both side walls of the positioning shaft. Peripheries of the shaft and positioning shaft are surrounded by positioning wall and restricting wall, and the shaft and a rotating base are hingedly coupled. A spring is disposed between the shaft and rotating base, and a shaft slot is formed downwardly from the shaft. An engaging portion is formed outside the rotating base, so that the spring can be connected and disposed between the shaft and rotating base. Upper periphery of the rotating base has driving teeth having at least one groove on a top surface thereof, and next to the groove is a restricting guiding groove, and an arc rail groove is next to the restricting guiding groove. A driving unit is disposed on the positioning shafts respectively, the driving unit having a rod to secure the string collecting bodies, and conjugating teeth are linked with the driving teeth of the rotating base. The upper cover is corresponding to the shell and has a restricting groove corresponding to the rotating base, and a ball is restricted in the groove of the restricting groove and the rotating base.

Comparing with the prior arts, the present invention is advantageous because the curtain structure in the present invention uses the spring and rotating base to achieve the goal of automatically restoring the curtain unit. The curtain unit can effectively expand, secure and restore through the use of the groove, the restricting guiding groove, arc rail groove and ball of the rotating base, which simplifies the string scrolling base and reduces the level of complexity of installation to further reduce the installation costs.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
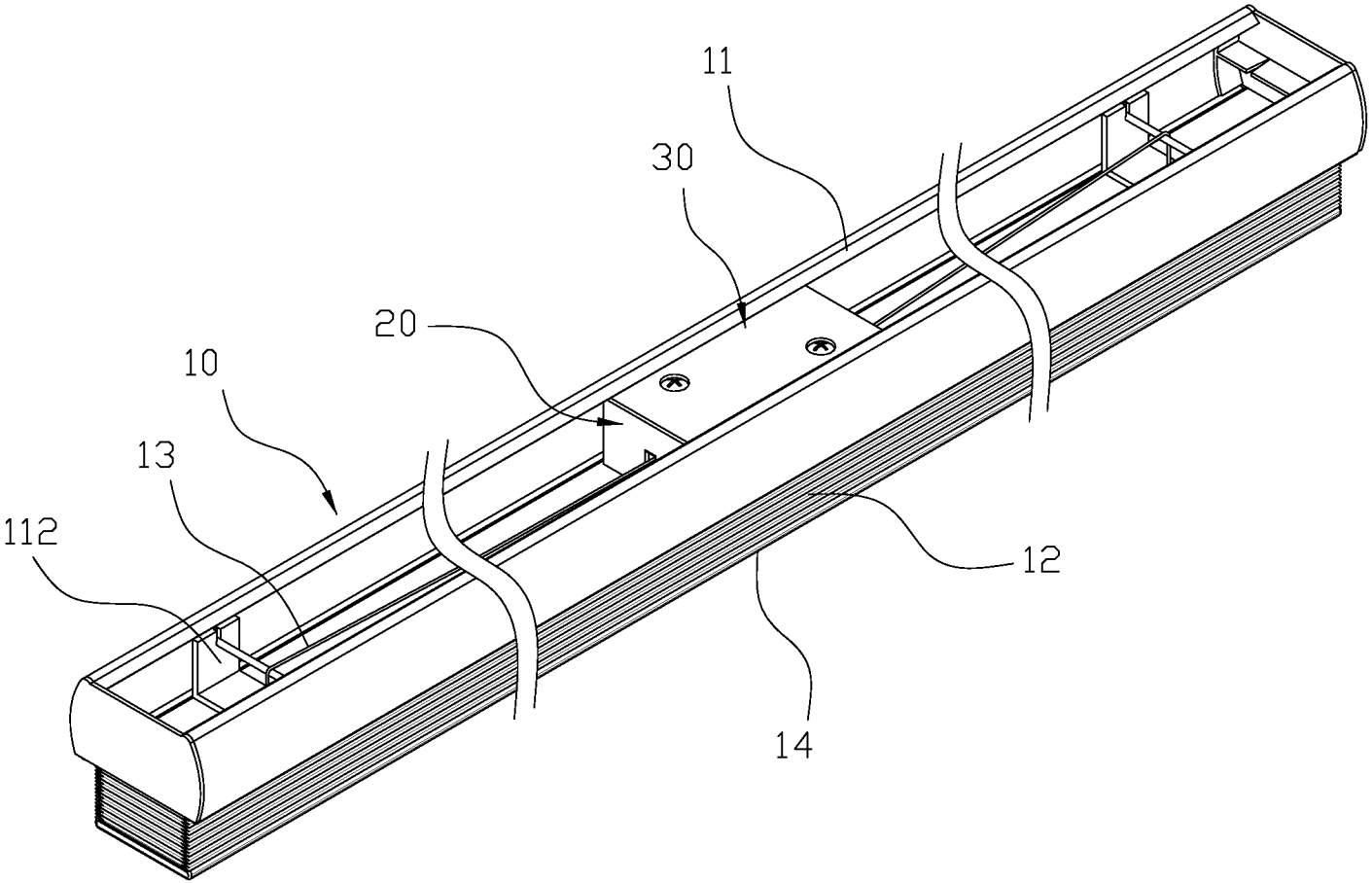
FIG. 1 illustrates a three-dimensional assembled view of the present invention.
Figure 2:
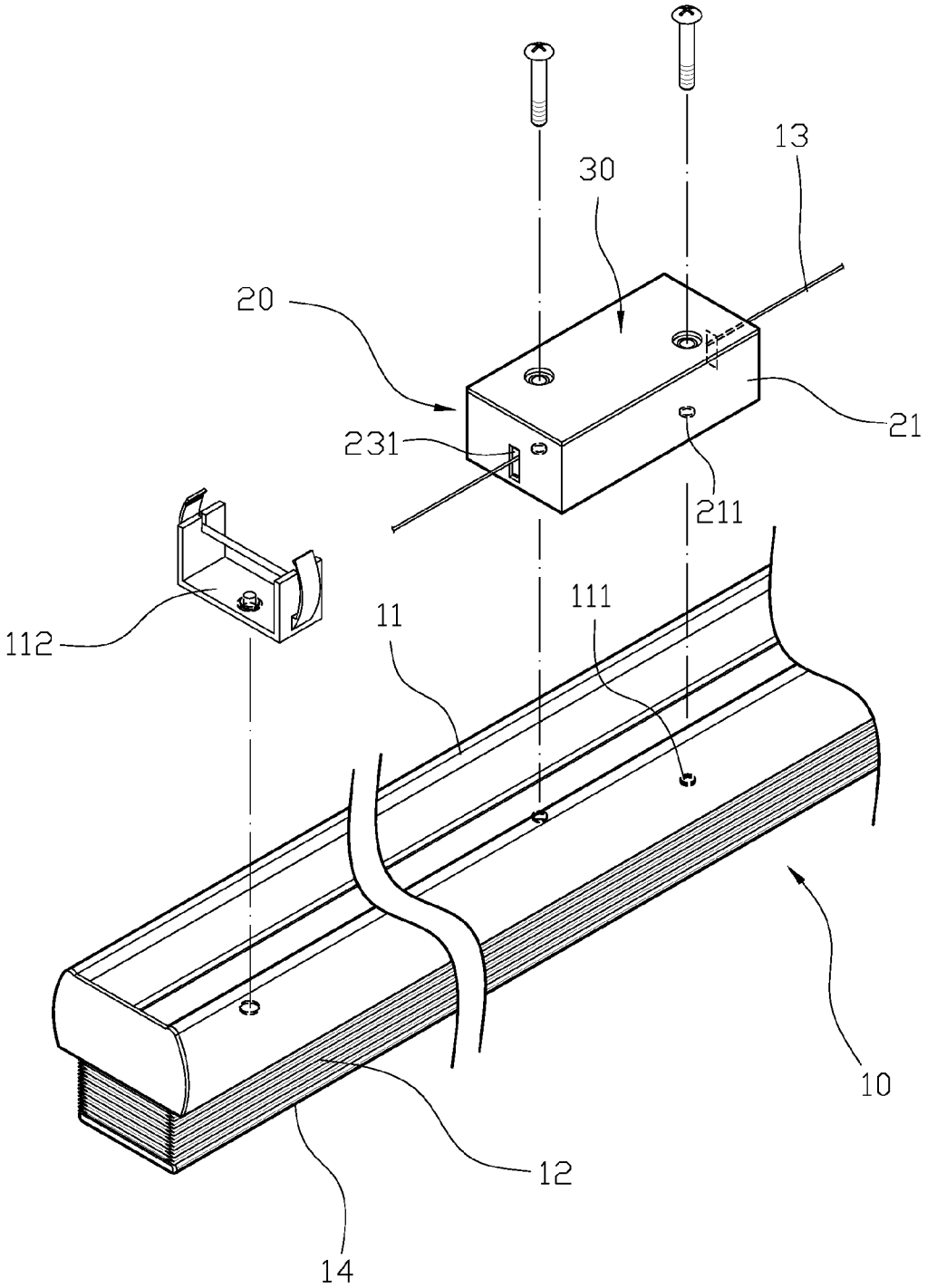
FIG. 2 illustrates a three-dimensional exploded view of the present invention.
Figure 3:
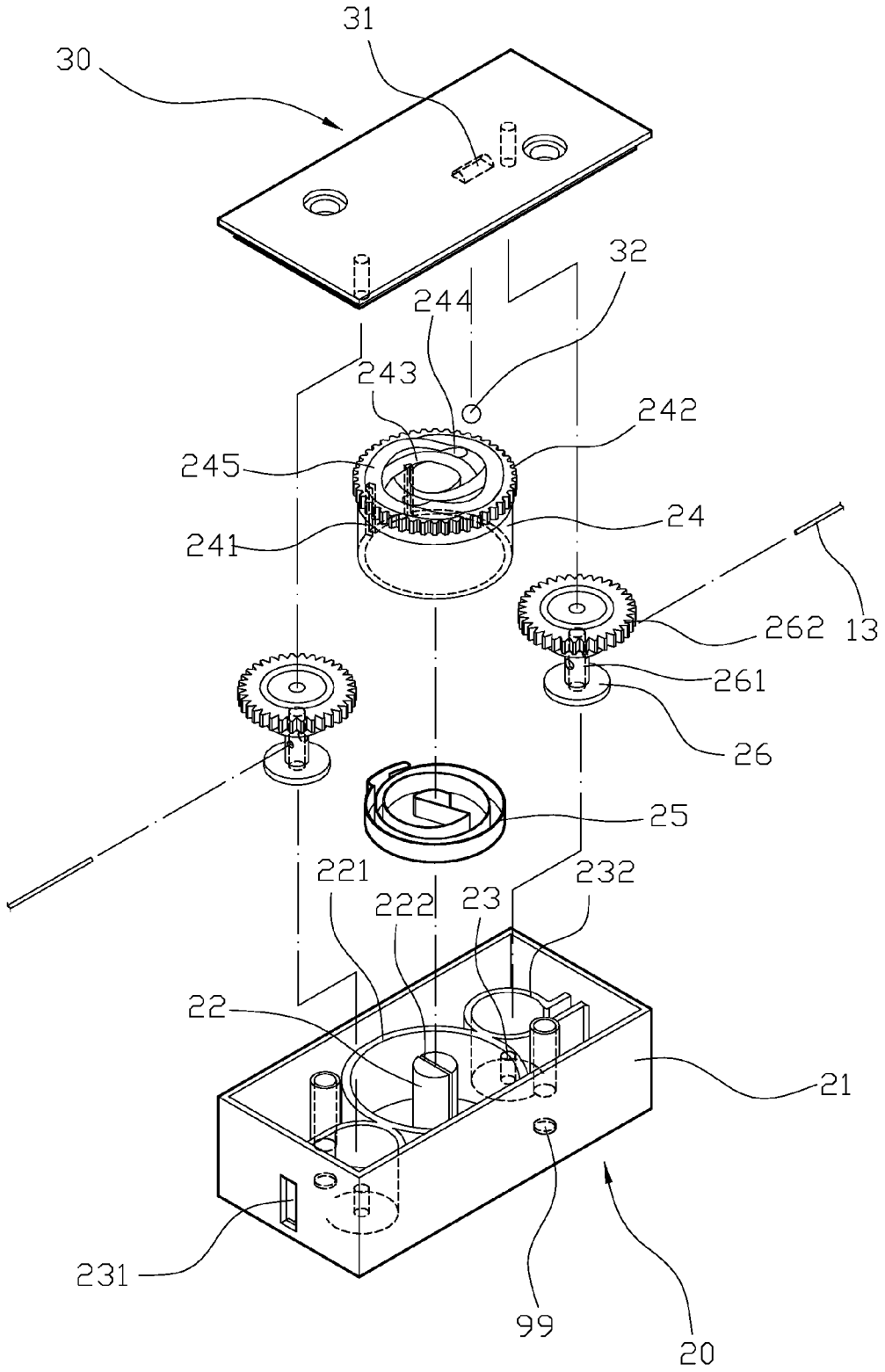
FIG. 3 illustrates a partial exploded view of the string scrolling base in the present invention.
Figure 4:
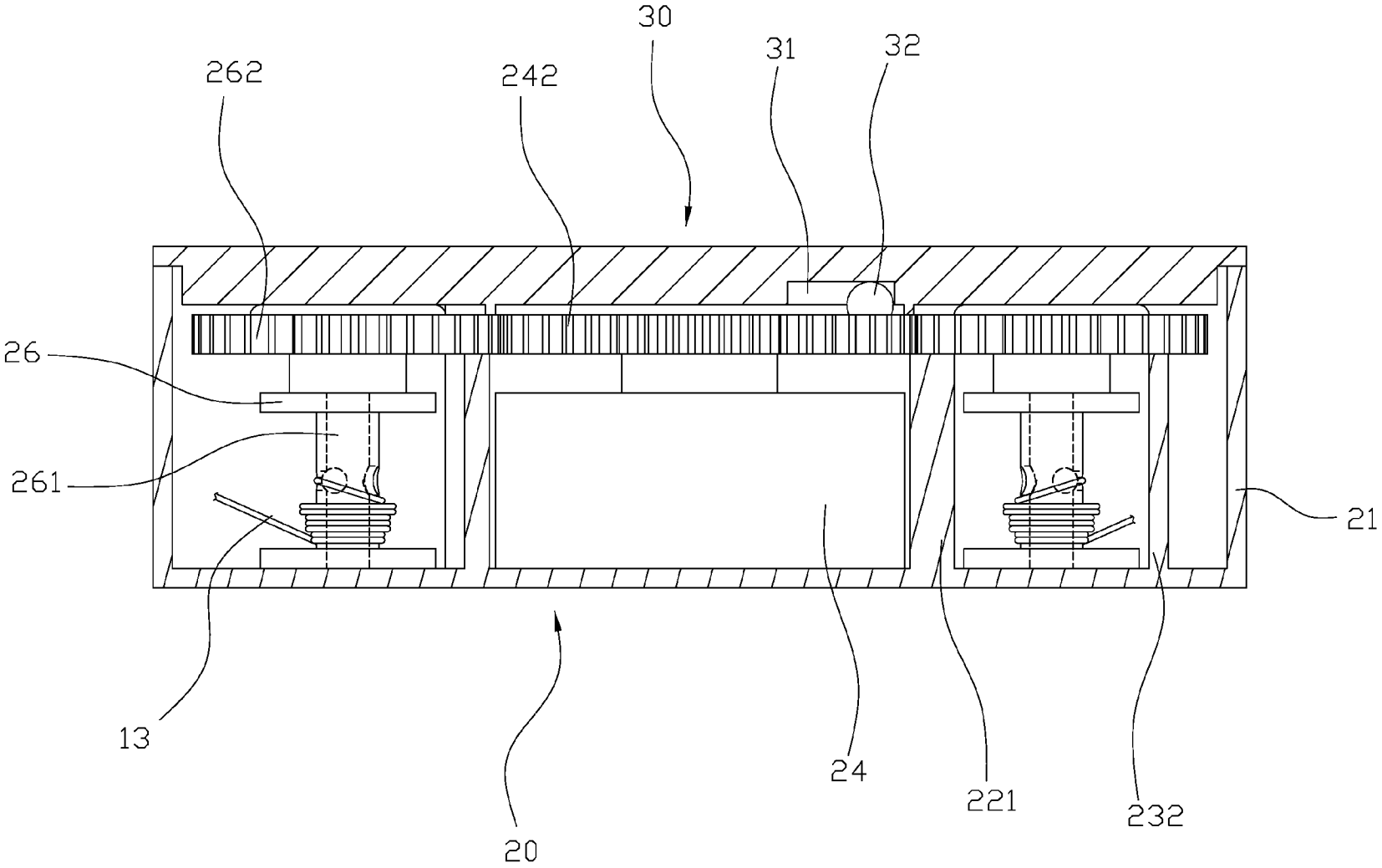
FIG. 4 illustrates a sectional view of the string scrolling base (which is not activated) in the present invention.
Figure 5:
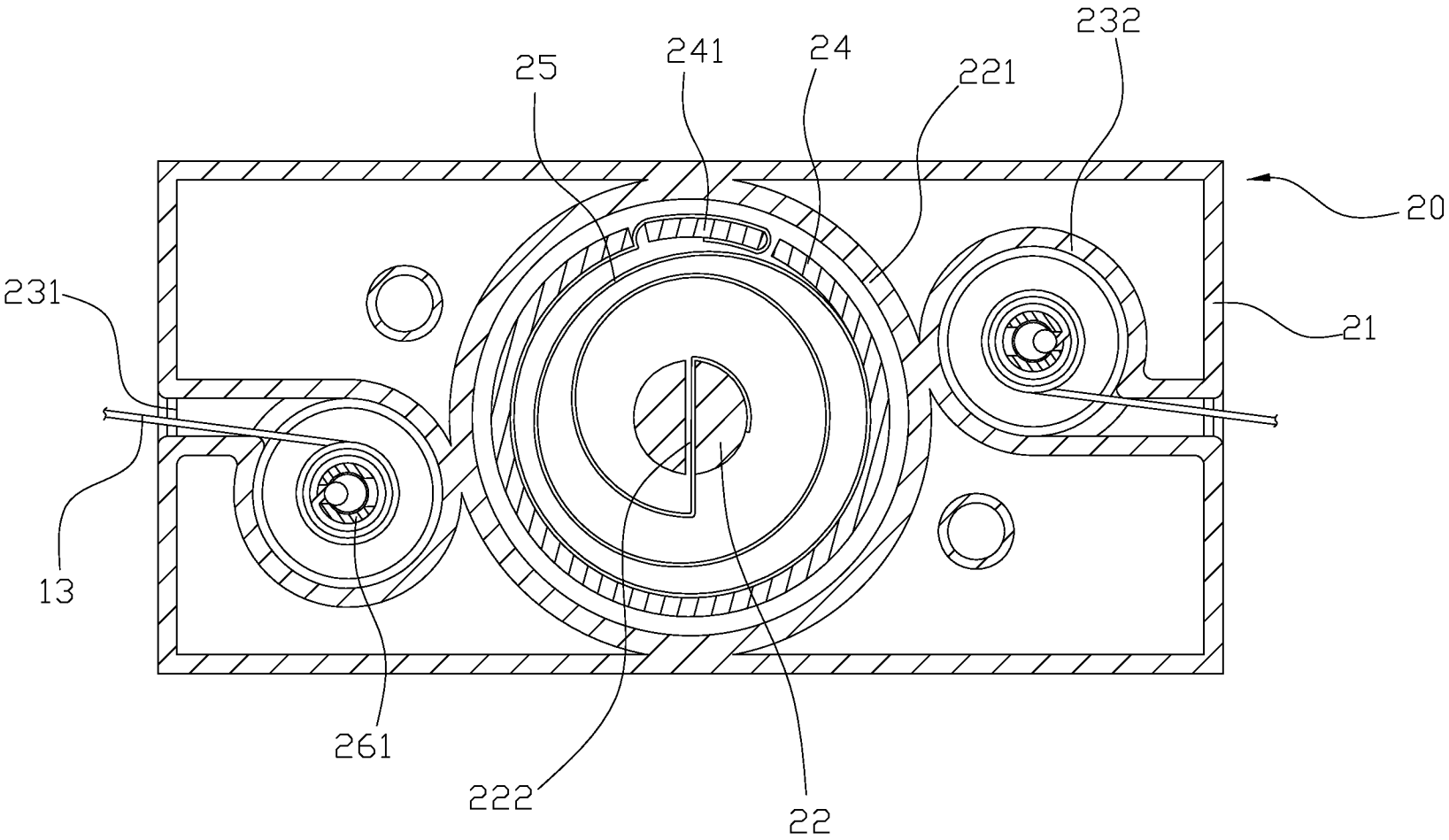
FIG. 5 illustrates another sectional view of the string scrolling base (which is not activated) in the present invention.
Figure 6:
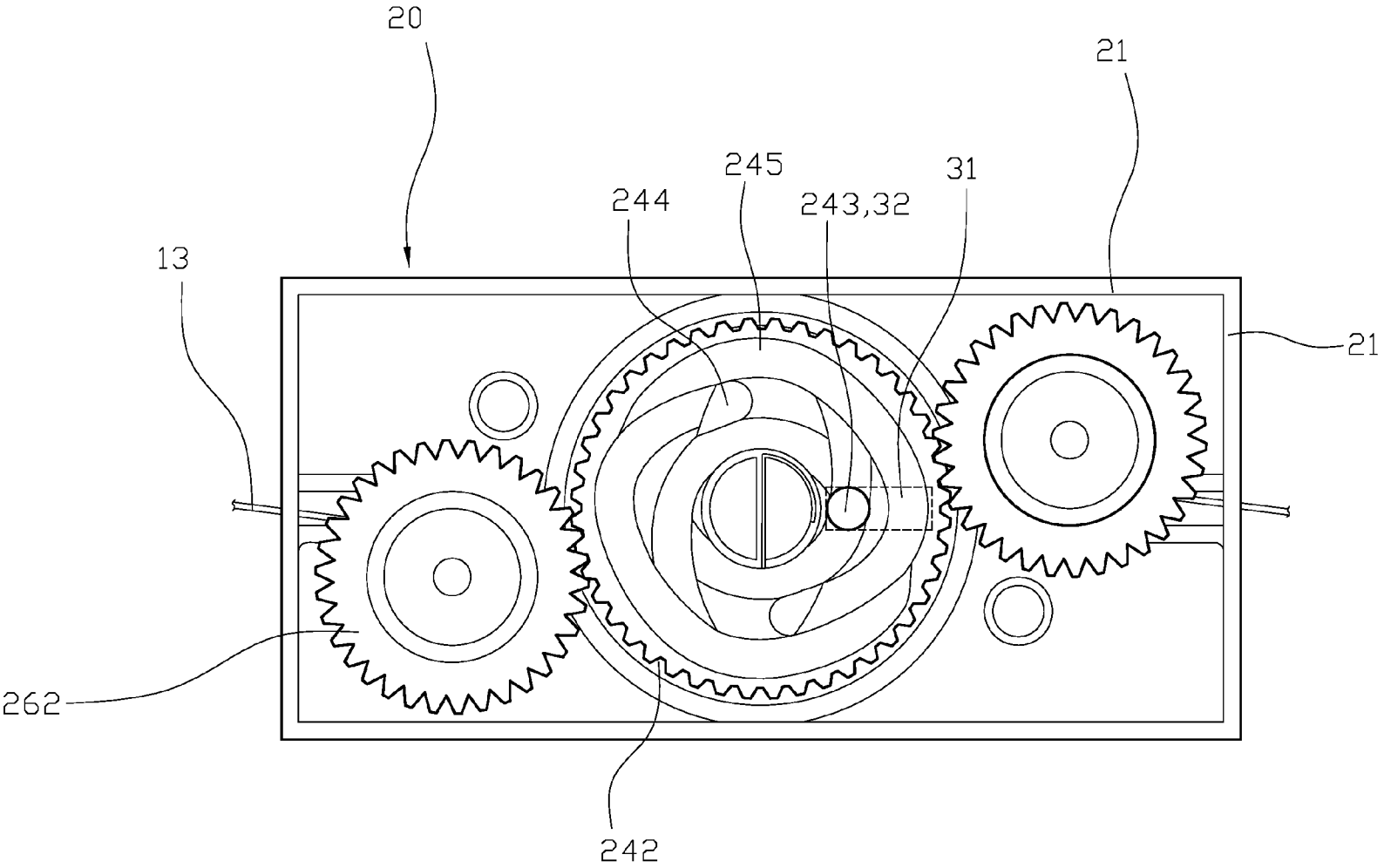
FIG. 6 illustrates a top view of the string scrolling base (which is not activated) in the present invention.
Figure 7:
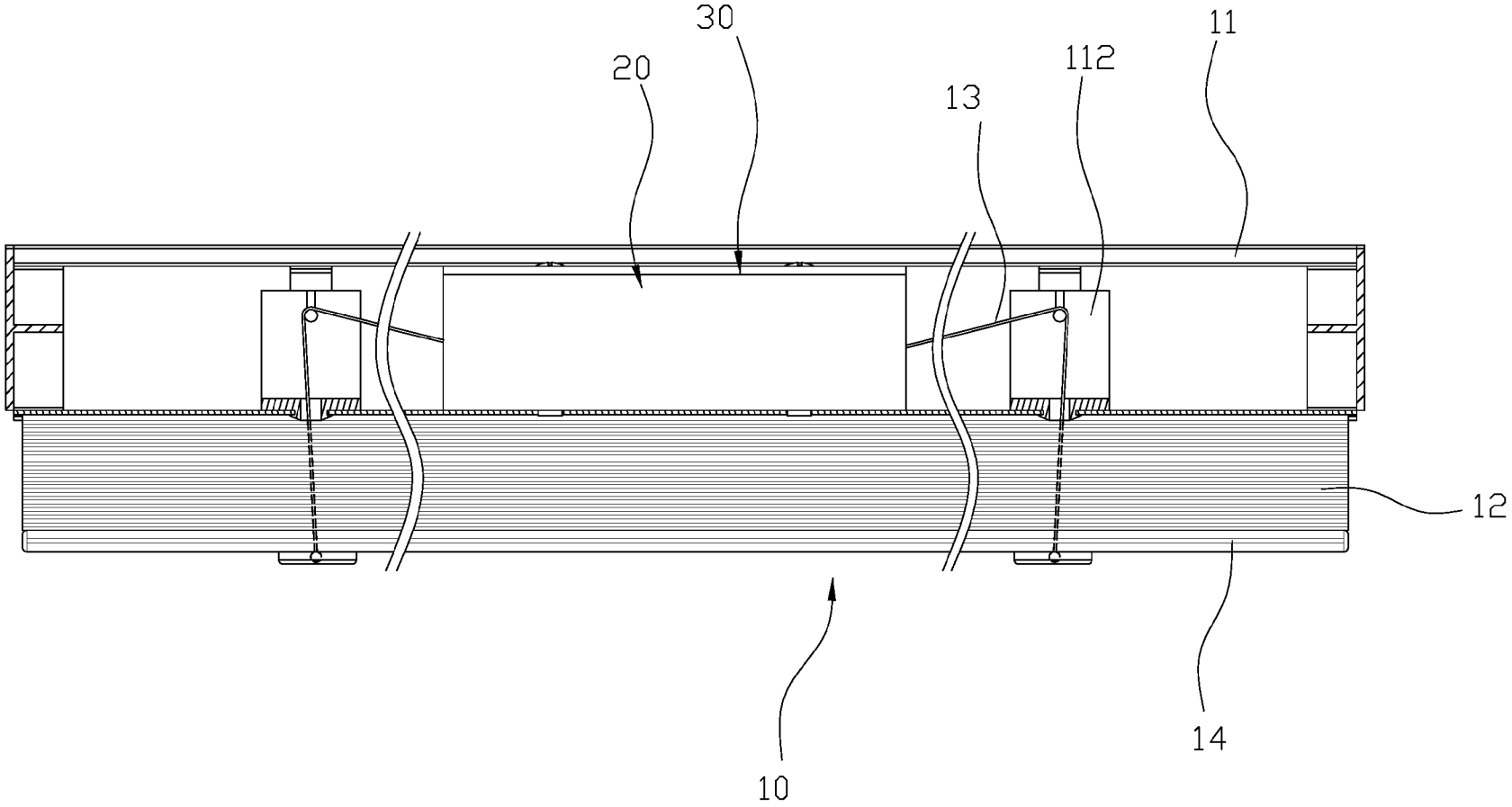
FIG. 7 illustrates the restored status of the curtain in the present invention.
Figure 8:
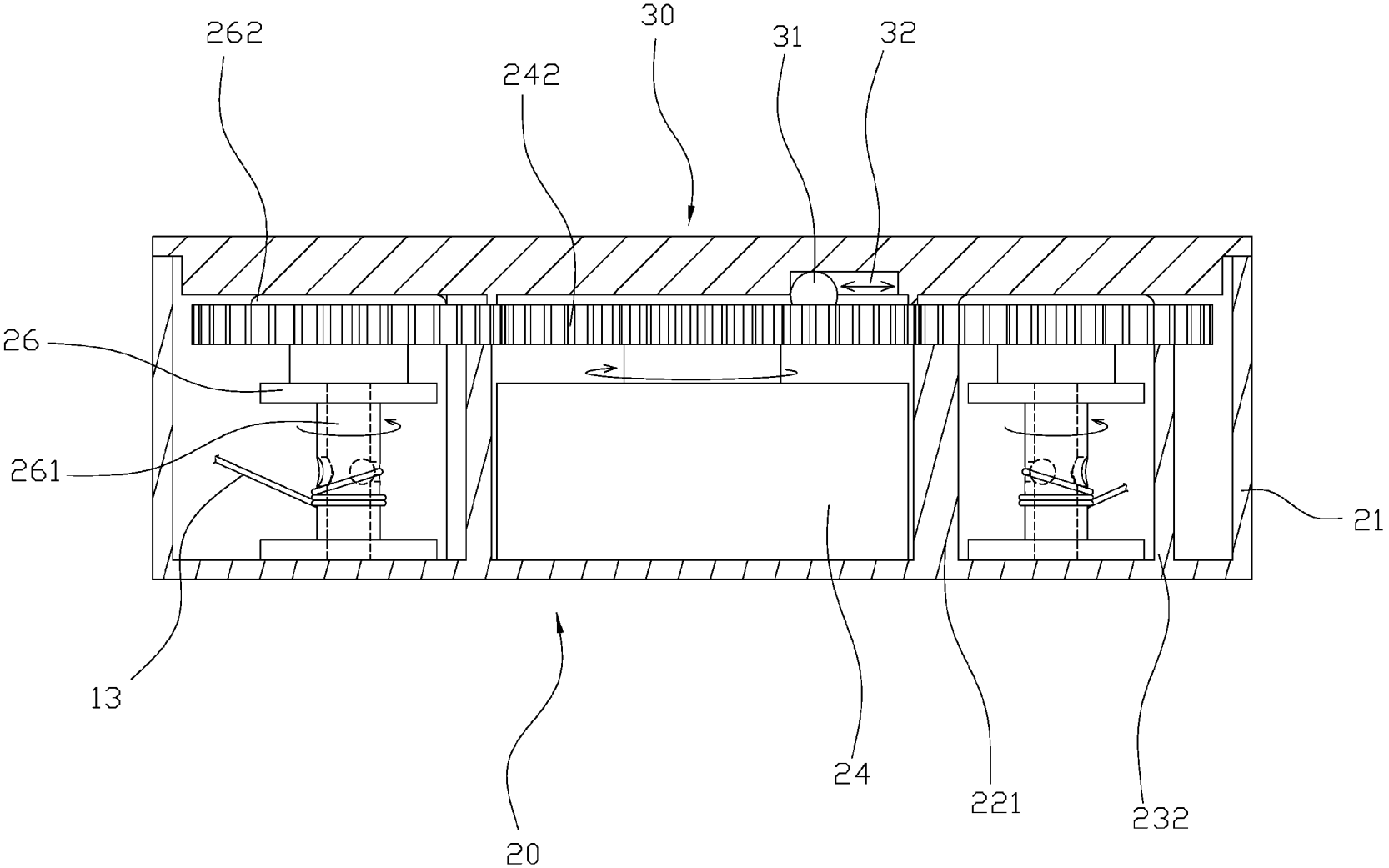
FIG. 8 illustrates a sectional view of the string scrolling base (which is activated) in the present invention.
Figure 9:
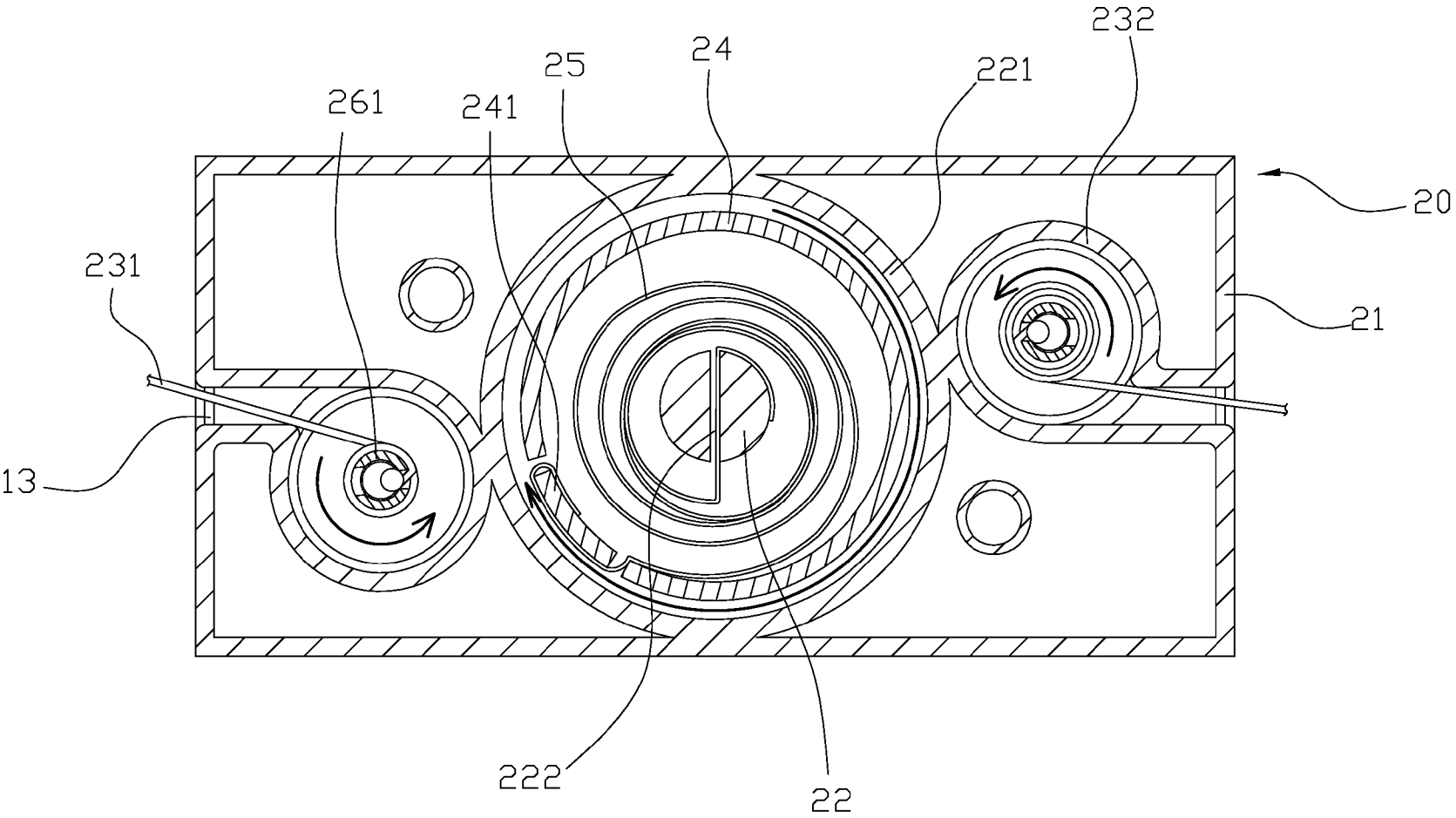
FIG. 9 illustrates another sectional view of the string scrolling base (which is activated) in the present invention.
Figure 10:
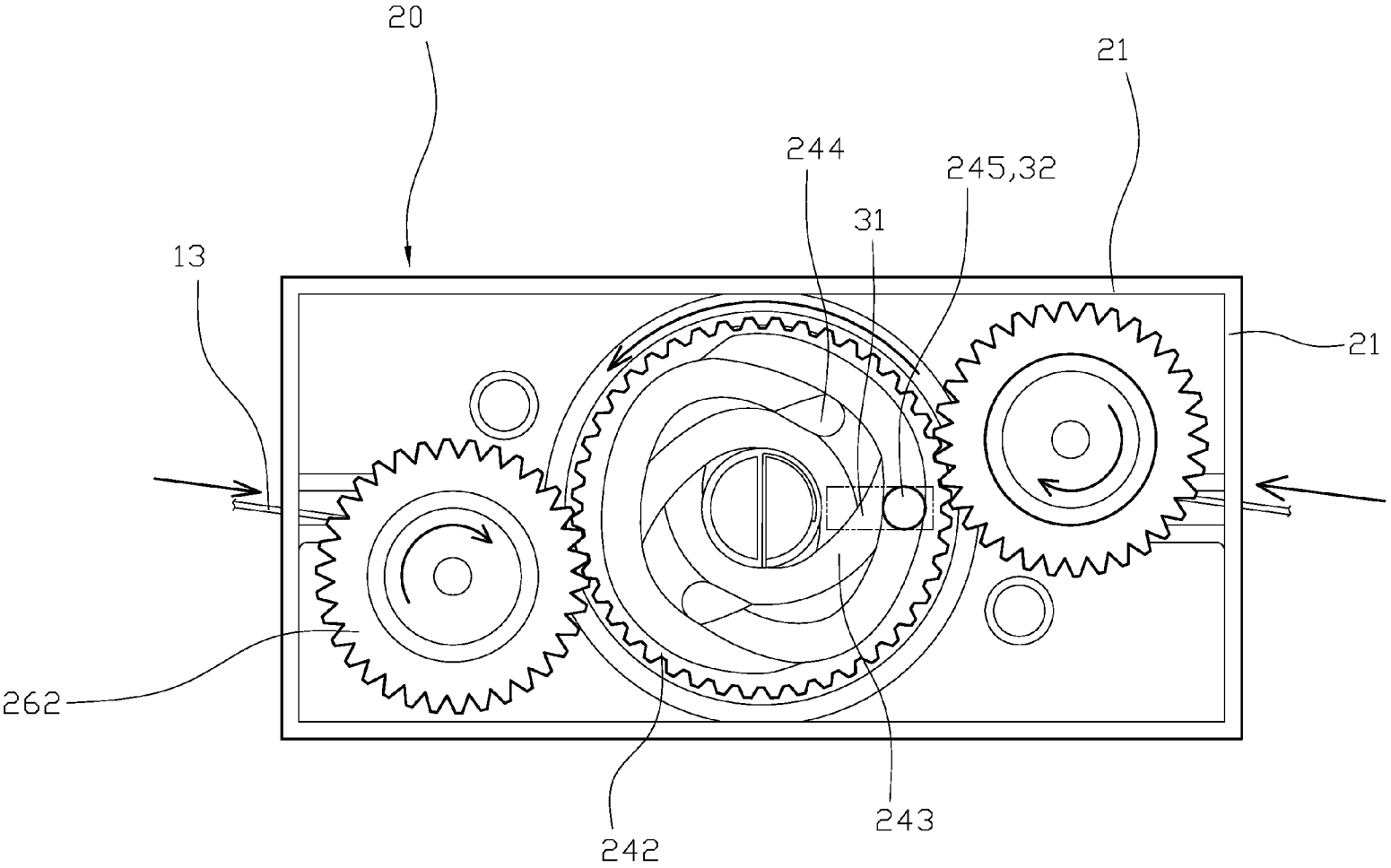
FIG. 10 illustrates a top view of the string scrolling base (which is activated) in the present invention.

In order to further understand the goal, characteristics and effect of the present invention, a number of embodiments along with the drawings are illustrated as following:

Referring to FIGS. 1 to 3, a curtain structure without drawstring may include a curtain unit (10), a string scrolling base (20) and an upper cover (30). The curtain unit (10) has a base (11) and curtain pieces (12) disposed downward therefrom. The base (11) is connected and driven by two string collecting bodies (13) and the bottom of the base (11) has a board (14). The string scrolling base (20) has a shell (21) disposed in the base (11) of the curtain unit (10), and two positioning slot (111) are disposed in the base (11) of the curtain unit (10), and bottom of the shell (21) of the string scrolling base (20) has protruding ribs (211), so as to secure the string scrolling base (20) inside the base (11). Center of the shell (21) has a shaft (22), both sides of which has a positioning shaft (23), and a line slot (231) is formed on both side walls of the positioning shaft (23). Peripheries of the shaft (22) and positioning shaft (23) are surrounded by positioning wall (221) and restricting wall (232), and the shaft (22) and a rotating base (24) are hingedly coupled. A spring (25) is disposed between the shaft (22) and rotating base (24), and a shaft slot (222) is formed downwardly from the shaft (22). An engaging portion (241) is formed outside the rotating base (24), so that the spring (25) can be connected and disposed between the shaft (22) and rotating base (24). Upper periphery of the rotating base (24) has driving teeth (242) having at least one groove (243) on a top surface thereof, and next to the groove (243) is a restricting guiding groove (244), and an arc rail groove (245) is next to the restricting guiding groove (244). A driving unit (26) is disposed on the positioning shafts (23) respectively, the driving unit (26) having a rod (261) to secure the string collecting bodies (13), and conjugating teeth (262) are linked with the driving teeth (242) of the rotating base (24). The upper cover (30) is corresponding to the shell (21) and has a restricting groove (31) corresponding to the rotating base (24), and a ball (32) is restricted in the groove (243) of the restricting groove (31) and the rotating base (24).

Referring to FIGS. 2 to 6 for the structure of the present invention, the string scrolling base (20) is equipped with the rotating base (24) through the shaft (22) at center portion of the string scrolling base (20), and the spring (25) is disposed through the shaft slot (222), and the other end of the spring (25) is secured at the engaging portion (241) of the rotating base (24). Two driving units (26) are disposed on the positioning shafts (23) located at both sides of the shaft (22), and have conjugating teeth (262) linked with the driving teeth (242) of the rotating base (24). The string collecting body (13) of the curtain unit (10) passes through the line slot (231) on both sides of the shell (21) to secure with the rod (261) of the driving unit (26), and the string can be scrolled and collected to the rod (261). The upper cover (30) is then engaged with the shell (21), so the ball (32) is restricted in the groove (243) of the restricting groove (31) and the rotating base (24) to complete the assembly of the string scrolling base (20), which is disposed in the base (11) of the curtain unit (10), and the protruding ribs (211) and the positioning slot (111) of the base (11) are engaged with each other. The string collecting body (13) extends from the line slot (231) on both sides of the shell (21), passes through a guiding unit (112) inside the base (11) to connect the curtain pieces (12), and passes through the board (14) to be secured to complete a curtain structure without drawstring.

Figure 11:
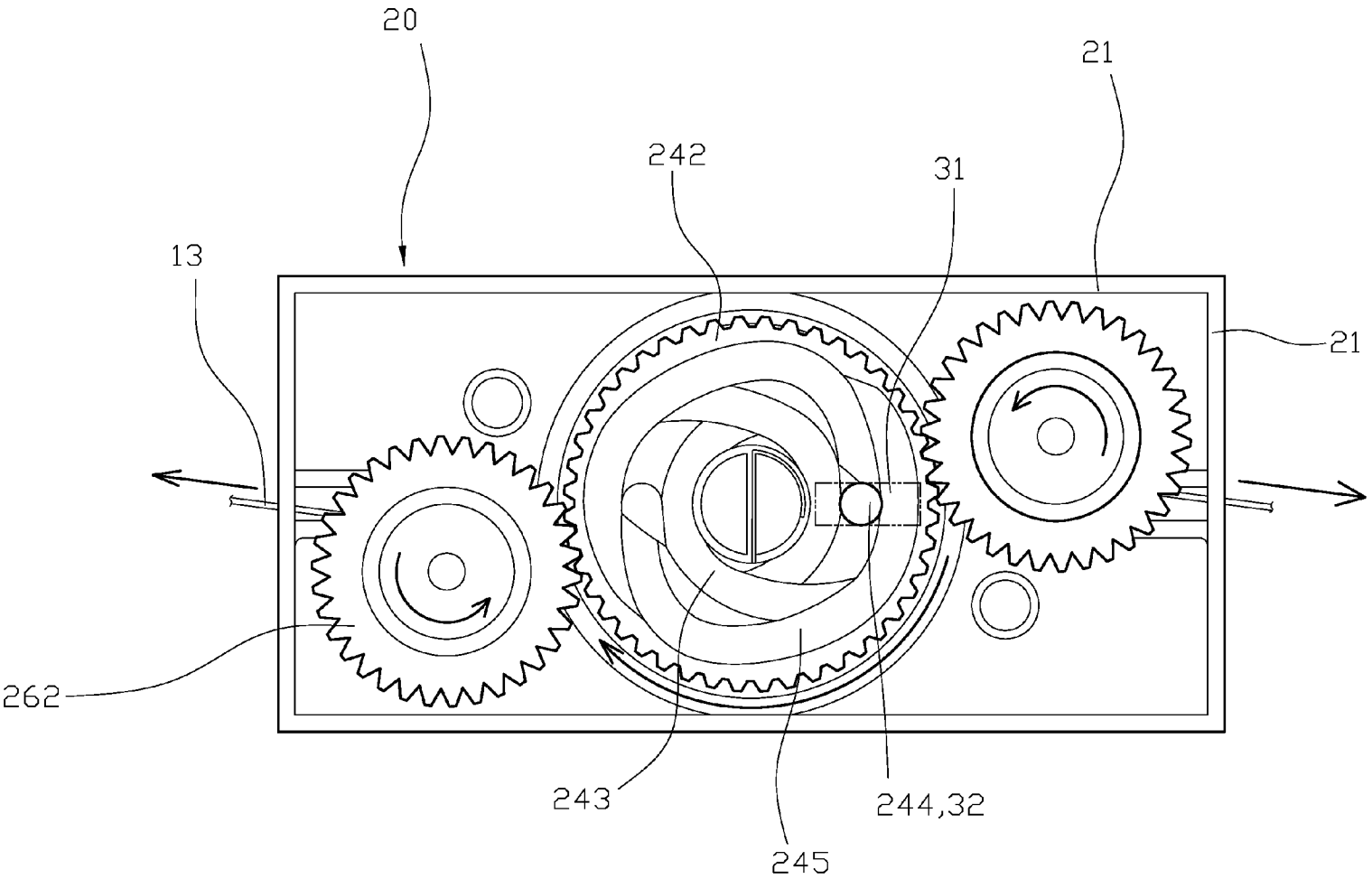
FIG. 11 illustrates a schematic view of the expanded curtain in the present invention.
Figure 12:
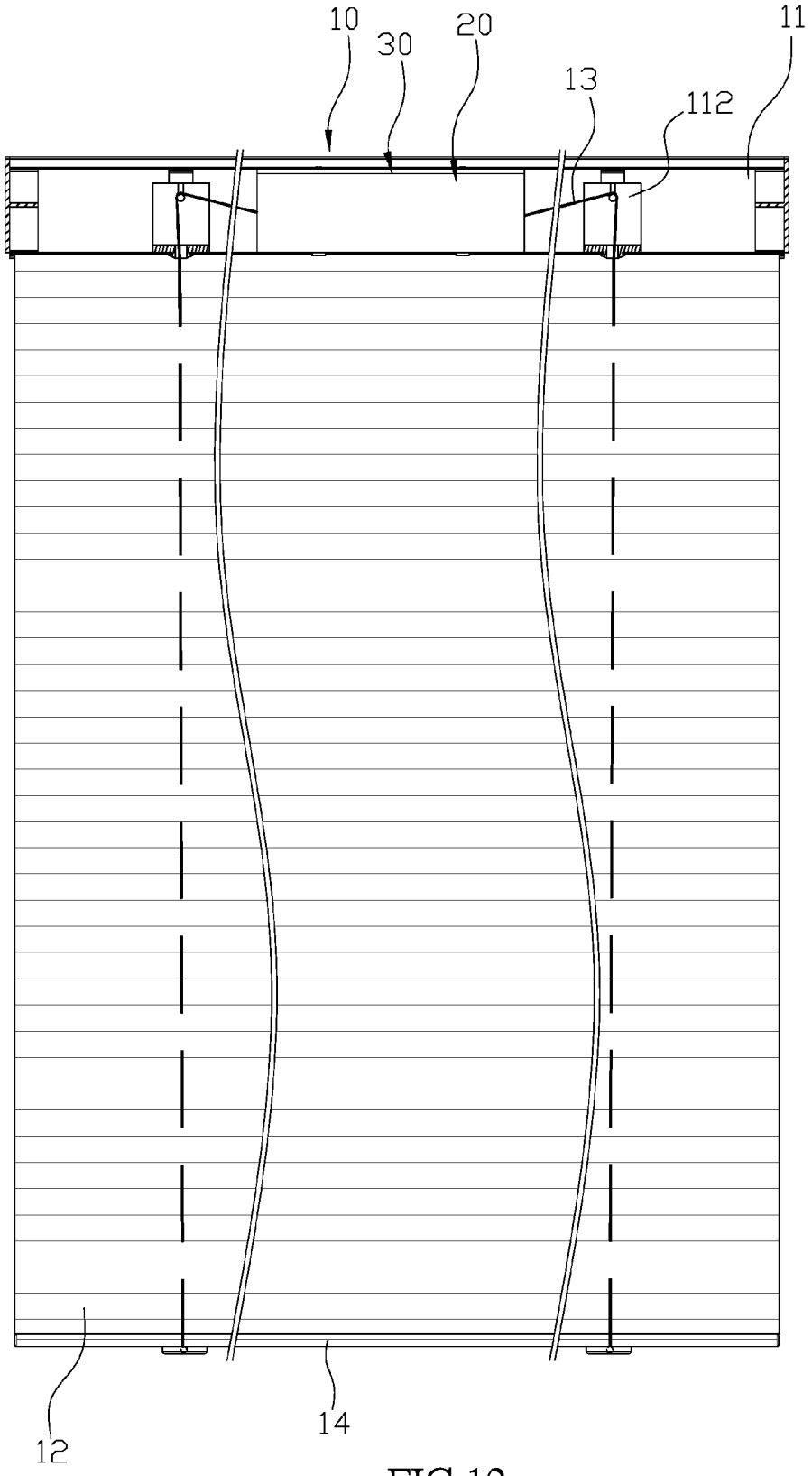
FIG. 12 illustrates a top view of the string scrolling base in a secured position.
Figure 13:
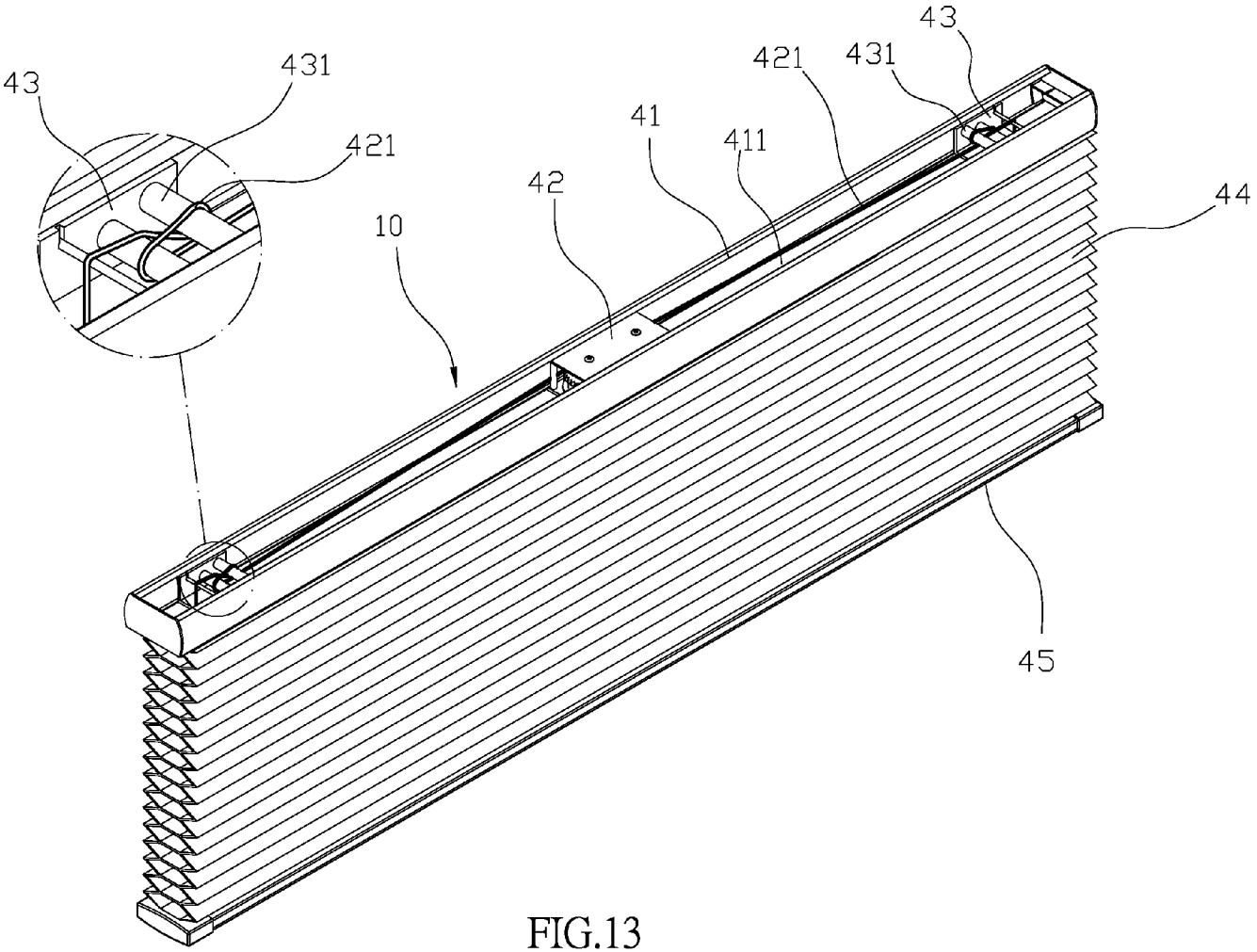
FIG.13 PRIOR ART
FIG. 13 illustrates a three-dimensional view of a prior art.

Referring to FIGS. 5 to 10 for the practical use of the structure, when the curtain unit (10) is not activated to restore, the string collecting body (13) is collected on the rod (261) of the driving unit (26), which is conjugated with the rotating base (24) and restricted by the resilient force of the spring (25). When the user pulls the board (14) to expand the curtain unit (10), the string collecting body (13) would be pulled out from the driving unit (26) of the string scrolling base (20) to rotate the driving unit (26) to drive the driving teeth (242) through the conjugating teeth (262), so that the rotating base (24) can rotate and press the spring (25) and the ball (32) in the groove (243) can move towards the arc rail groove (245) and the curtain pieces (12) of the curtain unit (10) can be continuously pulled out to expand (see FIG. 11).

Moreover, the curtain pieces (12) of the curtain unit (10) expand and the rotating base (24) rotates to press the spring (25). When the force of pulling down the curtain unit (10) through the board (14) decreases, the rotating base (24) would rotate toward the opposite direction because of the spring's resilient force, so the ball (32) moves to the restricting guiding groove (244) to form a secured position to determine the expanding length of the curtain pieces (12) due to the opposite rotation of the rotating base (24). If the user wants to expand the curtain unit (10) again, the board (14) can be pulled down again to expand the curtain pieces (12).

On the contrary, when the user wants to restore the expanded curtain unit (10), he/she can slightly pull down the board (14) so the ball (32) would leave the restricting guiding groove (244) to the groove (243). Meanwhile, the user can release the board (14) and the spring's resilient force can make the rotating base (24) rotate in the opposite direction and to drive the conjugating teeth (262) of the driving unit (26) through the driving teeth (242), so the string collecting body (13) can be collected to the rod (261) of the driving unit (26) to achieve the goal of automatically restoring the curtain unit (10).

According to the embodiments described above, the present invention is advantageous because the curtain structure in the present invention uses the spring (25) and rotating base (24) to achieve the goal of automatically restoring the curtain unit (10). The curtain unit (10) can effectively expand, secure and restore through the use of the groove (243), the restricting guiding groove (244), arc rail groove (245) and ball (32) of the rotating base (24), which simplifies the string scrolling base (20) and reduces the level of complexity of installation to further reduce the installation costs.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A curtain structure without a drawstring comprising a curtain unit, having a base and curtain pieces disposed downward therefrom, two string collecting bodies used to drive the curtain unit, and a board disposed on a bottom portion thereof;

a string scrolling base having a shell disposed in the base of the curtain unit, a center portion of the shell having a shaft, two positioning shafts located adjacent to opposing side walls of the shell so that the shaft is located between each positioning shaft, a line slot formed on each opposing side wall of the shell, wherein the shaft and a rotating base are hingedly coupled, and a spring disposed between the shaft and rotating base; and an upper periphery of the rotating base has driving teeth having at least one groove on a top surface thereof, wherein a restricting guiding groove is next to the at least one groove, and an arc rail groove is next to the restricting guiding groove; and a respective driving unit is disposed on each positioning shaft, each driving unit having a rod to secure the respective string collecting body, and conjugating teeth of the driving units are linked with the driving teeth of the rotating base; and an upper cover corresponding to the shell, having a restricting groove corresponding to the rotating base, and a ball restricted in the groove of the restricting groove and the rotating base.

2. The curtain structure of claim 1, wherein two positioning slots are disposed in the base of the curtain unit, and a bottom of the shell of the string scrolling base has protruding ribs, so as to secure the string scrolling base inside the base.

3. The curtain structure of claim 1, wherein peripheries of the shaft and positioning shafts are each surrounded by a positioning wall and a restricting wall.

4. The curtain structure of claim 1, wherein a shaft slot is formed downwardly from the shaft, and an engaging portion is formed outside the rotating base, so that the spring is connected and disposed between the shaft and rotating base.

* * * * *